US007134632B2

(12) United States Patent
Brown et al.

(10) Patent No.: US 7,134,632 B2
(45) Date of Patent: Nov. 14, 2006

(54) NON-POWERED TRAILED SWITCH DETECTOR FOR RAILROAD TRACK SWITCHING EQUIPMENT

(75) Inventors: Augustus Brown, Kearney, MO (US); Wallace M. Catanach, III, Blue Springs, MO (US); Andrew Ruggiero, Lee's Summit, MO (US); Michael Voth, Blue Springs, MO (US); Brandi Wood, Kansas City, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/193,082

(22) Filed: Jul. 29, 2005

(65) Prior Publication Data

US 2006/0180711 A1 Aug. 17, 2006

Related U.S. Application Data

(63) Continuation of application No. 11/057,289, filed on Feb. 11, 2005.

(51) Int. Cl.
*B61L 5/00* (2006.01)

(52) U.S. Cl. ..... 246/220; 246/253

(58) Field of Classification Search ..... 246/220, 246/253, 223, 476; 200/553, 557, 562, 563, 200/558, 554, 555, 559, 556

See application file for complete search history.

(56) References Cited

U.S. PATENT DOCUMENTS 2,575,994 A * 11/1951 Bone et al. ..... 200/18
5,598,992 A * 2/1997 Chew ..... 246/253
5,806,809 A * 9/1998 Danner ..... 246/220

FOREIGN PATENT DOCUMENTS

EP 1 348 607 * 1/2003
WO WO 014710 * 2/2004

OTHER PUBLICATIONS

International Search Report, PCT/US06/04804, filed Feb. 2006.*

* cited by examiner

*Primary Examiner*—Mark T. Le
(74) *Attorney, Agent, or Firm*—Gerald W. Spinks

(57) ABSTRACT

An apparatus for sensing movement of a point rail away from a stock rail by a selected distance, by closing a switch to shunt a track circuit. Manual resetting of the point rail is required to reset the apparatus to open the switch.

10 Claims, 6 Drawing Sheets

NON-POWERED TRAILED SWITCH DETECTOR FOR RAILROAD TRACK SWITCHING EQUIPMENT

CROSS REFERENCE TO RELATED APPLICATIONS

This is a continuation patent application of co-pending U.S. patent application Ser. No. 11/057,289, filed on Feb. 11, 2005, and entitled "Non-Powered Trailed Switch Detector for Railroad Track Switching Equipment."

STATEMENT REGARDING FEDERALLY SPONSORED RESEARCH OR DEVELOPMENT

Not Applicable

BACKGROUND OF THE INVENTION

1. Field of the Invention

This invention is in the field of railroad track switching equipment used to enable railroad vehicle traffic to pass along one or the other of two sets of tracks, at a point where the two sets of tracks merge into one set of tracks or where one set of tracks diverges into two sets of tracks, specifically equipment used to monitor the position of switching equipment at the merge/diverge point.

2. Background Art

In directing railroad vehicle traffic between one set of tracks and two sets of diverging tracks, with vehicles moving in either direction, it is well known to shift a set of point rails transversely, to cause one or the other of the point rails to contact a stationary stock rail. When viewed from the perspective of the single set of tracks, if the right hand point rail aligns with the right hand stock rail, traffic will be directed from the single set of tracks onto the left set of diverging tracks, or traffic coming from the left set of diverging tracks can pass onto the single set of tracks. Conversely, if the left hand point rail aligns with the left hand stock rail, traffic will be directed from the single set of tracks onto the right set of diverging tracks, or traffic coming from the right set of diverging tracks can pass onto the single set of tracks.

With this common type of switching arrangement, if the right hand point rail is aligned with the right hand stock rail, and if a rail vehicle passes from the right hand set of diverging tracks onto the single set of tracks, the right hand point rail will be forced away from the right hand stock rail. In this situation, commonly called a trailed switch condition, the right hand point rail may simply deflect and then return almost to its original alignment with the right hand stock rail, but remain somewhat separated from the right hand stock rail. This results in a condition which could lead to derailment when the next rail vehicle moving along the single set of tracks passes through the switch point, since neither the right hand point rail nor the left hand point rail aligns with its respective stock rail. In other words, the right wheel of the rail vehicle will attempt to follow the right hand set of diverging tracks, while the left wheel of the rail vehicle will attempt to follow the left hand set of diverging tracks. Even if the point rail rebounds to its original position in contact with the stock rail, the switch machine which holds the point rails in position may have been damaged and rendered incapable of adequately holding the point rail in position against the stock rail. This can still result in the derailing of a rail vehicle passing through the switch. It is necessary, therefore, to send an operator to a trailed switch, to inspect the switching apparatus and reset the trailed switch detector.

It is known to have a shunt switch, commonly called a circuit controller switch, positioned to sense movement of the point rail away from the stock rail by a selected distance, at which point the shunt switch will shunt the associated track circuit, indicating that the point rail has moved away from the stock rail. Providing this separate circuit controller switch, possibly calling for an additional housing and connecting apparatus, obviously adds some expense and complexity to the switching arrangement. Further, some currently available switch machines are sufficiently robust that, after a train passes through the switch from the wrong set of diverging tracks, the switch machine will allow the point rail to rebound to a position sufficiently close to the stock rail that the circuit controller switch will immediately open, and the track circuit will no longer be shunted. So, in spite of the added cost of providing the circuit controller switch to detect the trailed switch condition, such known systems do not reliably sense the existence of a trailed switch condition.

Therefore, it is necessary to have apparatus for sensing when a trailed switch condition exists, and to prevent the trailed switch sensing apparatus from resetting itself even if the point rail moves back into contact with its stock rail.

BRIEF SUMMARY OF THE INVENTION

The present invention is an apparatus in which an actuator holds open a shunt switch, called a trailing move detector switch, in a track circuit, when the point rail is in contact with the stock rail. When the point rail moves a selected distance away from the stock rail, the actuator closes the trailing move detector switch, shunting the track circuit. The actuator will not reset and re-open the trailing move detector switch, until the point rail has been fully shifted to a reset position, thereby avoiding the situation where the track circuit might only momentarily be shunted if the point rail rebounds into contact with the stock rail. This requires an operator to go to the site and reset the sensing apparatus after inspecting the switch machine and related equipment.

In one embodiment, an actuator cam is spring loaded to rotate in a first direction to a first actuator position, to hold a trailing move detector switch open. A point rail position sensor, such as a rail follower piston, moves with the point rail and interacts with the actuator cam. When movement of the point rail causes the point rail follower piston to rotate the actuator cam sufficiently to pull the cam loading spring past a "high point" or point of maximum extension, the loading spring then rotates the actuator cam in a second, opposite, direction to a second actuator position, to allow the trailing move detector switch to close. Even if the point rail rebounds toward the stock rail, the actuator cam remains in the "tripped" second actuator position, fully rotated in the second direction, and it will not open the trailing move detector switch. This allows the trailing move detector switch to remain closed.

When the point rail is driven through its full stroke, however, a reset plate driven by the movement of the point rail follower piston rotates the actuator cam in the first direction until the cam loading spring moves back past its high point, thereafter again biasing the actuator in the first direction to the first actuator position, thereby "resetting" the actuator cam. Then, returning the point rail to contact with the stock rail will cause the actuator cam to again open the trailing move detector switch.

In a second embodiment, when the point rail is in contact with the stock rail, a contactor base holds an actuator pawl in a first rotational direction in a first actuator position, in which the actuator pawl holds the trailing move detector switch open. The actuator pawl is biased to rotate in a second, opposite, direction by a loading spring, to rotate away from the trailing move detector switch and toward the contactor base. Movement of the point rail away from the stock rail by a selected distance causes the point rail follower piston to displace the actuator pawl away from the contactor base, or vice versa, allowing the pawl loading spring to rotate the actuator pawl in the second direction away from the trailing move detector switch to a second actuator position, allowing the trailing move detector switch to close, thereby shunting the track circuit. Even if the point rail rebounds toward the stock rail, the actuator pawl remains in its "tripped" second actuator position, fully rotated in the second direction, and it will not open the trailing move detector switch. This allows the trailing move detector switch to remain closed.

When the point rail is driven through its full stroke, however, the actuator pawl contacts a reset bar mounted to the housing of the apparatus, which rotates the actuator pawl in the first direction again, until the actuator pawl is retained in its first position by a latch, thereby "resetting" the actuator pawl. Then, returning the point rail to contact with the stock rail will cause the actuator pawl to again open the trailing move detector switch. As the actuator pawl moves into contact with the trailing move detector switch, once the actuator pawl is again held in its first position by the contactor base, the contactor base releases the actuator pawl from the latch.

Either of these embodiments can also incorporate a circuit controller switch and actuator, as discussed above. This type of actuator, however, will open the circuit controller switch without being reset. An example of such an actuator would be a lever adapted to be rotated by movement of the point rail follower piston, to open and close the circuit controller switch. Incorporating this type of circuit controller switch in the same housing with the trailing move detector switch, and using the same point rail follower piston to actuate the circuit controller switch, can reduce the cost and complexity associated with providing a circuit controller switch.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
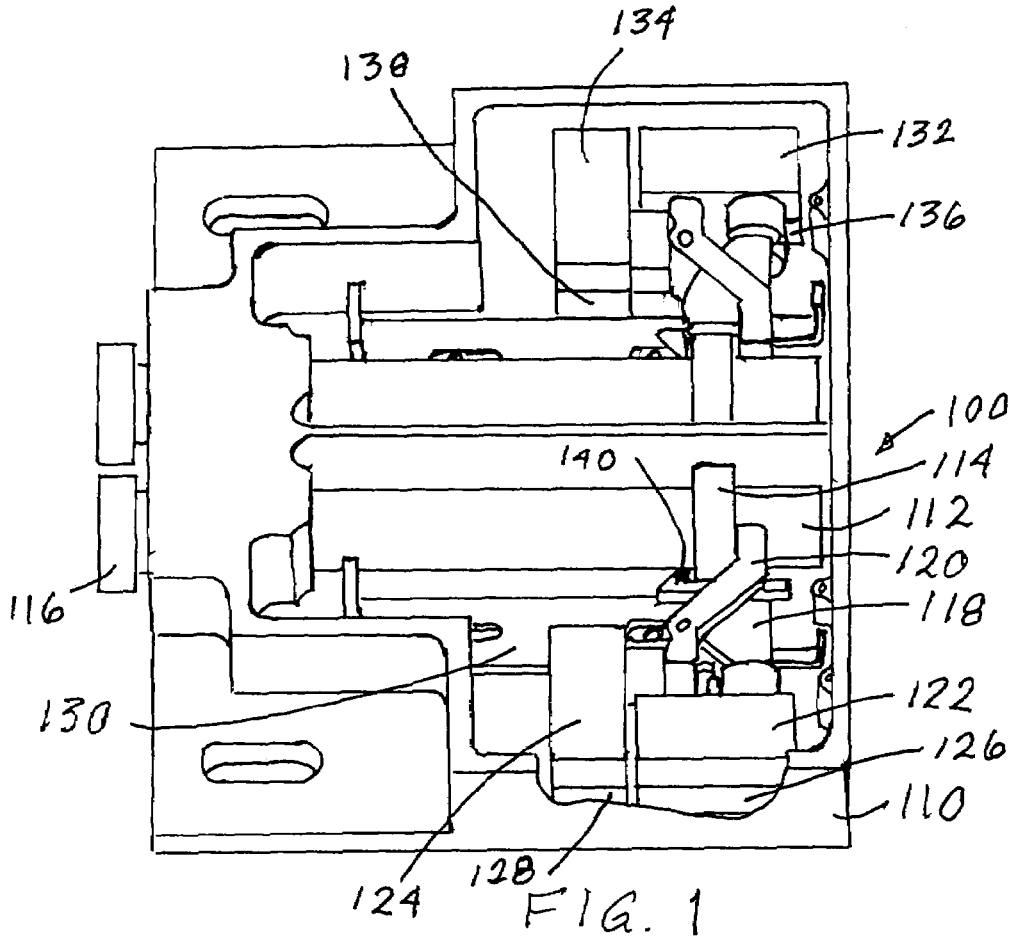
FIG. 1 is a perspective view of a first embodiment of the apparatus of the present invention.
Figure 3:
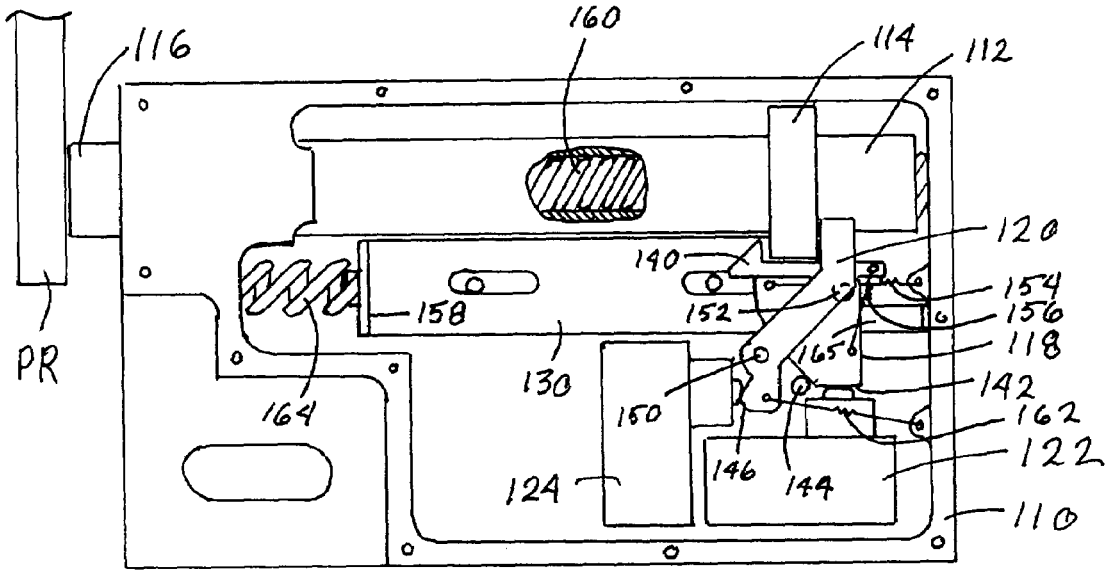
FIG. 3 is a plan view of a portion of the apparatus shown in FIG. 1.

As shown in FIG. 1, a first embodiment of the apparatus 100 of the present invention includes a housing 110 in which are mounted one or more point rail follower pistons 112. A collar 114 is fixedly mounted on each follower piston 112, and a distal end 116 of each follower piston 112 is adapted to remain in contact with and follow a point rail PR, as shown in FIG. 3. Only half of the apparatus 100 is shown in FIG. 3, for simplicity. FIG. 3 also shows that a spring 160 can be used to bias the follower piston 112 to remain in contact with the point rail PR.

Figure 2:
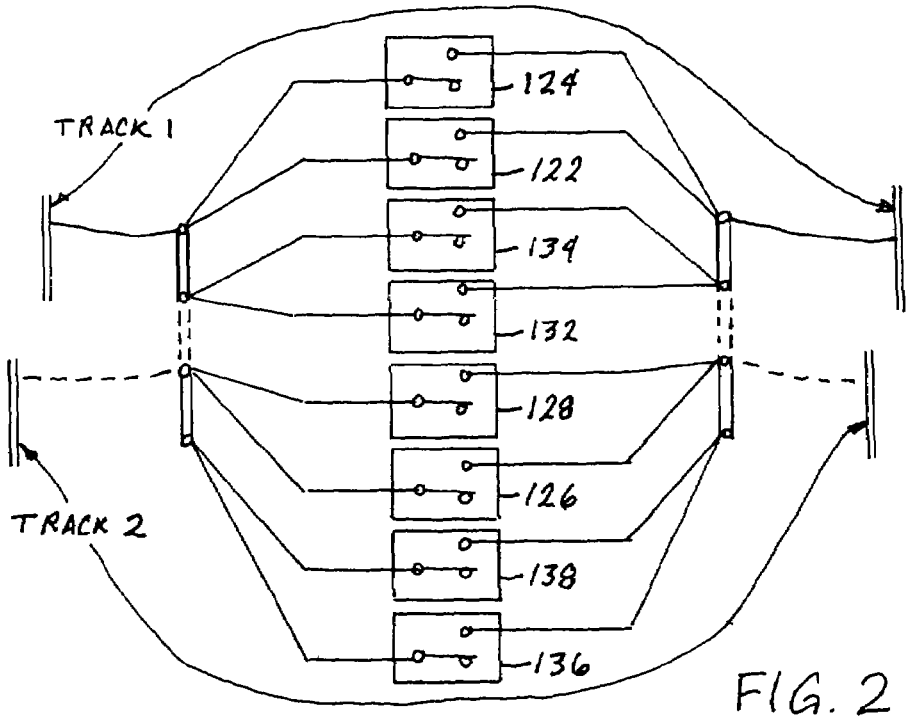
FIG. 2 is a circuit diagram of a switching arrangement according to the present invention.

An actuator cam 118 is positioned to interact with the collar 114 on each follower piston 112, and each actuator cam 118 selectively opens a pair of trailing move detector switches 122, 126 or 132, 136. A circuit controller lever 120 can also be provided for each follower piston 112, with each circuit controller lever 120 actuating a pair of circuit controller switches 124, 128 or 134, 138. As shown in FIG. 2, the trailing move detector switches 122, 126, 132, 136 and the circuit controller switches 124, 128, 134, 138 are connected to selectively shunt one or two track circuits to alert operators of a possible trailed switch condition. All eight switches can be connected to a single track circuit, such as Track 1, by connecting the terminal bars as shown in dashed lines. If there are two adjacent tracks to be monitored, the switches are segregated by removal of the dashed portion of the terminal bars. Closing of any one of the switches will shunt its respective track circuit. All of the switches are biased toward the closed position.

As seen better in FIG. 3, the actuator cam 118 pivots about a cam shaft 152. When the apparatus 100 is in the fully reset position shown in FIGS. 1 and 3, a cam loading spring 154 biases the actuator cam 118 in a first, clockwise, direction, causing the switch contact face 142 on the actuator cam 118 to contact and open the related trailing move detector switches 122, 126. This is the first actuator position of the actuator cam 118. Rotation of the actuator cam 118 farther in the clockwise direction past this point is prevented by contact between the actuator cam 118 and a cam position stop post 144. A start clasp 140 is pivotally mounted to the actuator cam 118, with its left hand hooked end engaging the collar 114 when the collar 114 is in its farthest right position, corresponding to the position in which the point rail PR contacts its respective stock rail. The hooked left hand end of the start clasp 140 is held in engagement with the collar 114 by a clasp spring 156 which pulls the right hand end of the start clasp 140 away from the follower piston 112. The circuit controller lever 120 pivots about a lever shaft 150. One end of the circuit controller lever 120 is biased against the collar 114 by a lever spring 162. When the collar 114 is in its farthest right position, as shown, it holds the contact face 146 of the other end of the lever 120 in contact with the related circuit controller switches 124, 128, holding these switches in the open position.

Figure 4:
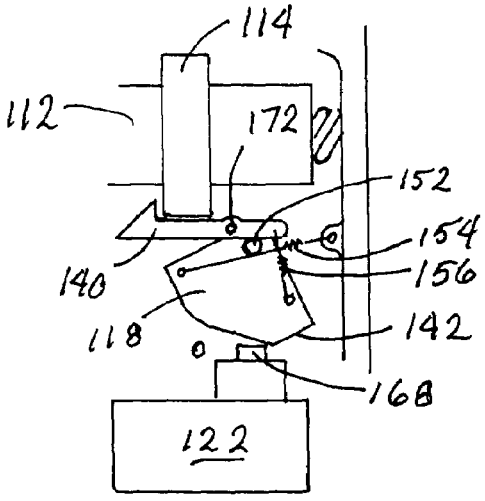
FIGS. 4 and 5 are plan views showing the tripping of the switches shown in FIG. 1 to shunt the track circuit.

As shown in FIG. 4, when the follower piston 112 and the collar 114 move to the left, along with the point rail PR, the collar 114 moves the start clasp 140 to the left, causing the actuator cam 118 to rotate counter-clockwise under the action of a suitable mechanism for providing a biasing force, such as the cam loading spring 154. At approximately three-sixteenths of an inch of movement in the left direction, the cam loading spring 154 reaches its "high point" as it passes over the center of rotation of the actuator cam 118, at the cam shaft 152. In this first portion of the range of motion of the actuator cam 118, the cam loading spring 154 biases the actuator cam in the clockwise direction. After this point, in the second portion of its range of motion, the actuator cam 118 is biased in the counter-clockwise direction to the second actuator position of the actuator cam 118. It can be seen that as the start clasp 140 rotates about the clasp shaft 172 relative to the actuator cam 118, the clasp spring 156 brings the right hand end of the start clasp 140 into contact with the cam shaft 152 to stop rotation of the start clasp 140 relative to the actuator cam 118. It can also be seen that at approximately this point, the contact face 142 of the actuator cam 118 no longer contacts the contact button 168 of the trailing move detector switch 122. The circuit controller lever 120 is omitted from FIG. 4 for clarity.

Figure 5:
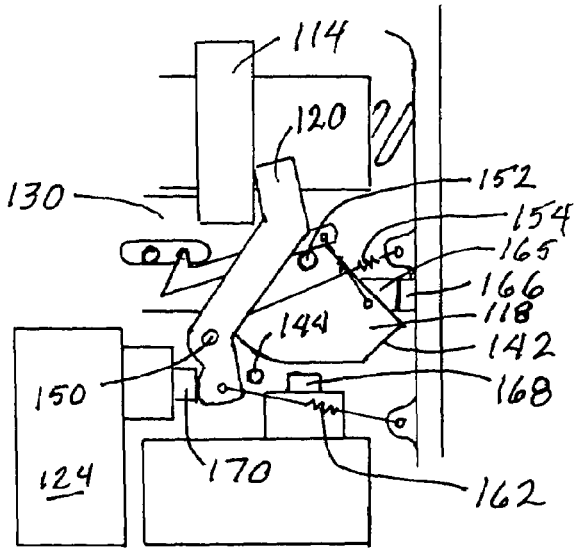

As shown in FIG. 5, when the collar 114 has moved to the left by one fourth of an inch, the contact button 168 of the trailing move detector switch 122 has been completely released, closing the switch and shunting the related track circuit. This is the second actuator position of the actuator cam 118. Further, the start clasp 140 has continued to rotate with the actuator cam 118, until the hooked end of the start clasp 140 has cleared the collar 114. It can also be noted that, at this point, the circuit controller lever 120 has rotated counterclockwise, biased by the lever spring 162, as the distal end of the circuit controller lever 120 follows the collar 114, until the contact face 146 of the circuit controller lever 120 has released the contact button 170 of the circuit controller switch 124. This closes the circuit controller switch 124, also shunting the track circuit.

If the point rail PR were to rebound to the right at this point, it can be seen that the circuit controller lever 120 would rotate to the right, opening the circuit controller switch 124. However, the actuator cam 118 would remain in its counter-clockwise rotated second actuator position, held there by the cam loading spring 154. Therefore, the actuator cam 118 will not open the trailing move detector switch 122, and the track circuit will remain shunted. An operator can then go to the site and inspect the necessary equipment. The operator can then manually stroke the switch machine through its full stroke and return it to its original setting. When the point rail is moved to the left end of its stroke, the collar 114 moves to the left until it contacts an upright lip 158 on the left end of the reset plate 130, and move the reset plate 130 to the left against the bias of the plate spring 164. An extension 165 on the right end of the reset plate 130 has an upright lip 166. As the reset plate 130 moves to the left, the lip 166 on the plate extension 165 contacts the edge of the actuator cam as indicated best in FIG. 5. Continued movement of the collar 114 to the left end of its stroke pulls the lip 166 farther left, causing the actuator cam 118 to rotate in the clockwise direction. As the actuator cam 118 rotates in the clockwise direction, the cam loading spring 154 passes back over its "high point", after which the cam loading spring 154 biases the actuator cam 118 fully in the clockwise direction until it reaches its "reset" first actuator position, contacting the position stop 144. Thereafter, as the point rail PR is moved back to the right to contact the stock rail, the collar 114 moves back to the right, deflecting the hooked end of the start clasp 140 as it passes. This returns the apparatus 100 to the condition shown in FIG. 3.

Figure 6:
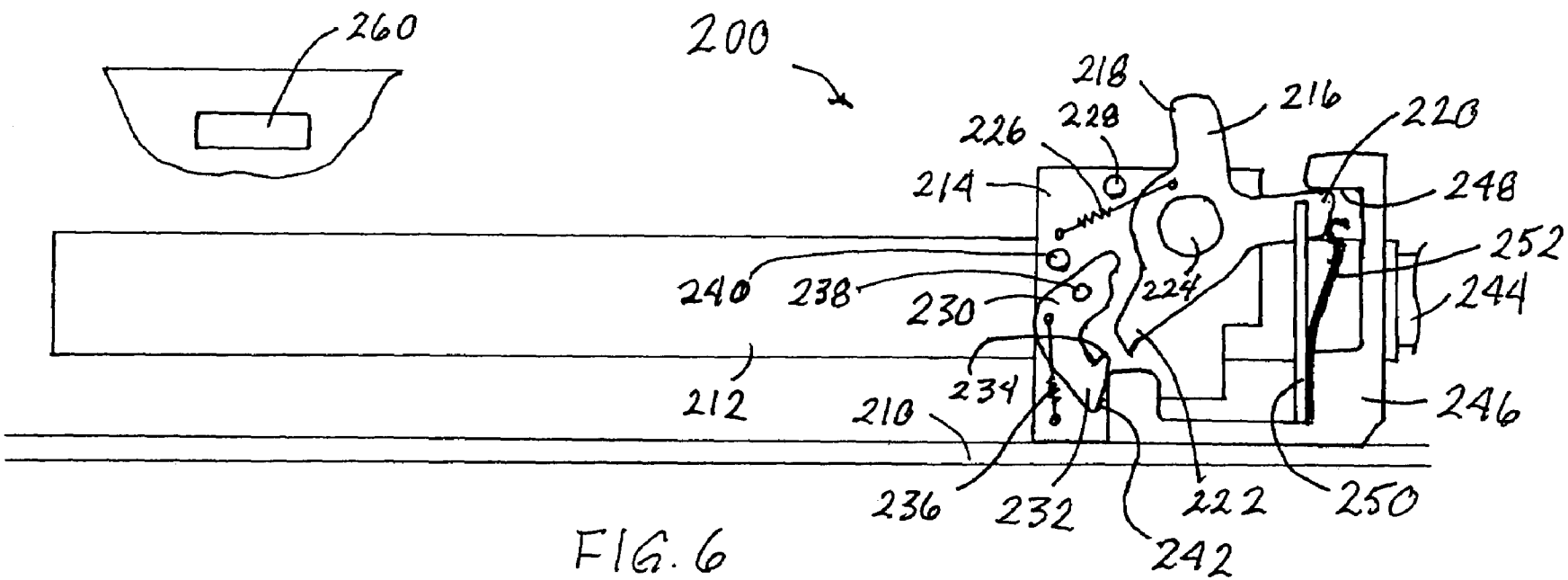
FIG. 6 is an elevation view of a second embodiment of the apparatus of the present invention.

In a second embodiment of the apparatus 200 shown in FIG. 6, a follower block 214 is mounted to the point rail follower piston 212. A contact base 246 is mounted to the housing 210, with a trailing move detector switch 250 mounted to the contact base 246. The trailing move detector switch 250 can be, for example, a simple circuit board with a flexible contact arm 252 biased toward the circuit board. When the contact arm 252 contacts the switch 250, the switch is closed. An actuator pawl 216 is pivotably mounted on a pawl shaft 224 on the follower block 214. A suitable mechanism for providing a biasing force, such as a pawl spring 226 biases the actuator pawl 216 in the counter-clockwise direction. A latch 230 is pivotably mounted on a latch post 238 to the follower block 214. A latch spring 236 biases the latch 230 in the counter-clockwise direction. FIG. 6 shows the apparatus 200 in its "reset" position, with the trailing move detector switch 250 open, corresponding to the farthest right position of the point rail PR. It can be seen that the contact extension 220 of the actuator pawl 216 is pushing the contact arm 252 of the trailing move detector switch 250 to the open position. The contact extension 220 can pass through a notch in the circuit board of the switch 250. The contact extension 220 is held in this position by the pawl position stop face 248 of the contact base 246. This is the first actuator position of the actuator pawl 216. It can be seen that the latch 230 does not engage the actuator pawl 216 at this point.

Figure 7:
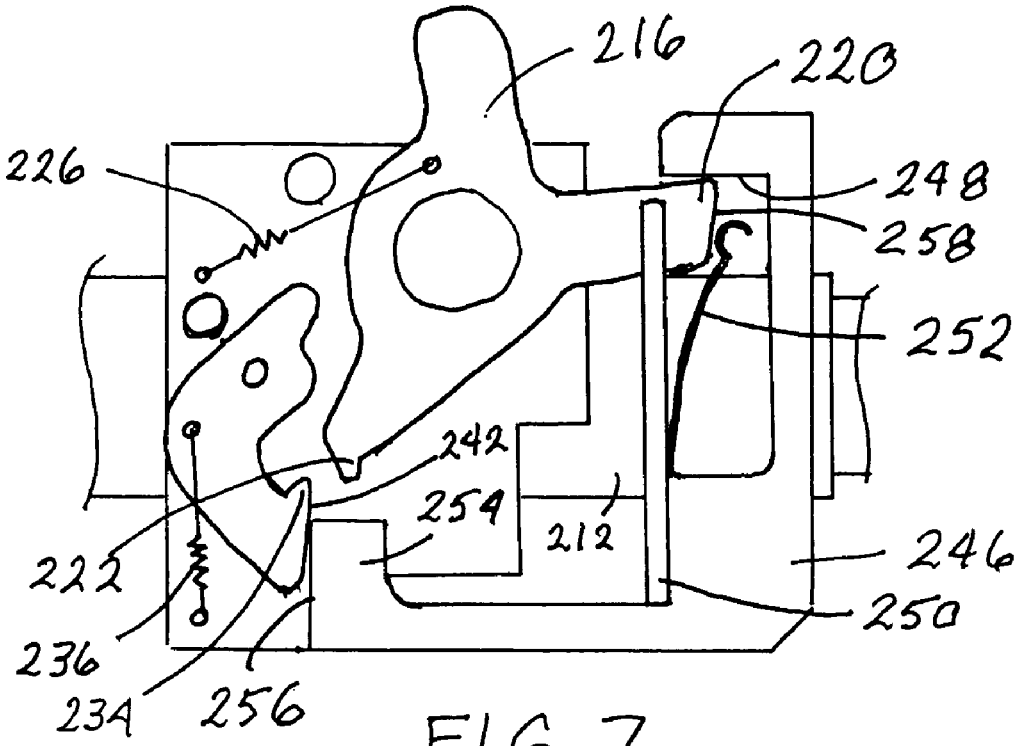
FIGS. 7 and 8 are elevation views showing the tripping of the switch shown in FIG. 6 to shunt the track circuit.
Figure 8:
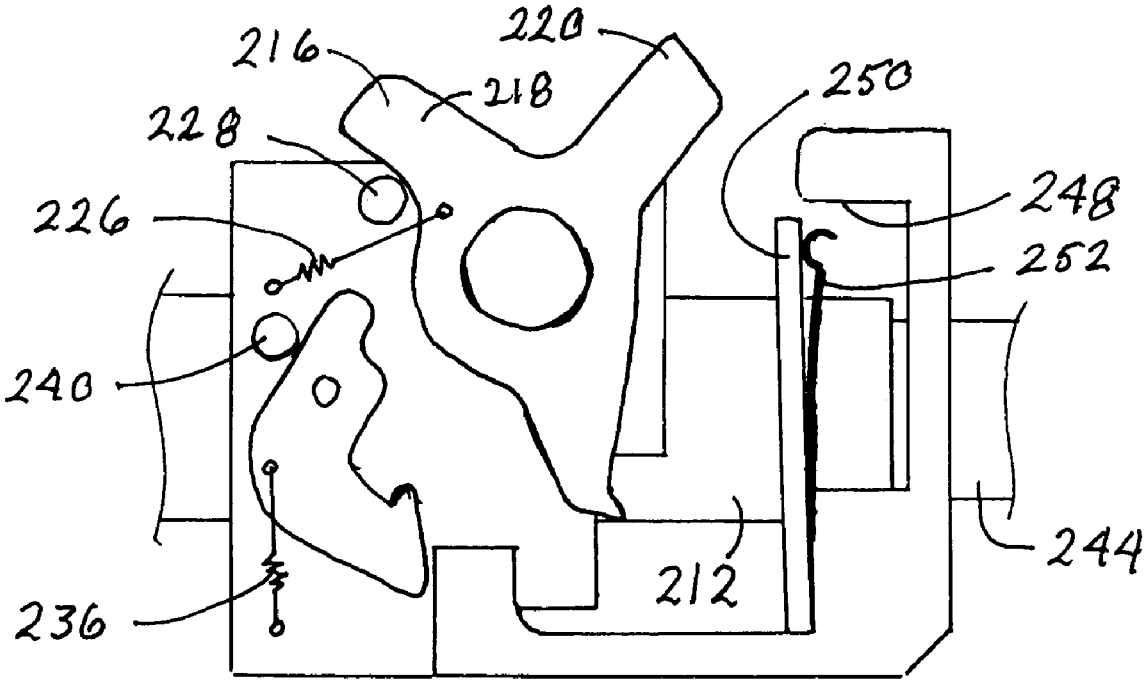

FIG. 7 better shows this position, with the switch contact face 258 of the actuator pawl 216 contacting the switch contact arm 252, and with the latch contact face 256 of the lower extension 254 of the contact base 246 being contacted by the base contact face 242 of the latch 230. The lower lip 222 of the actuator pawl 216 does not engage the hook 234 of the latch 230. As the point rail PR moves to the left, away from the stock rail, the follower piston 212 and the follower block 214 move to the left. After one fourth inch movement to the left, the contact extension 220 of the actuator pawl 216 clears the pawl position stop face 248 of the contact base 246. This allows the pawl spring 226 to rotate the actuator pawl 216 in the counter-clockwise direction until the reset extension 218 of the actuator pawl 216 contacts the pawl stop post 228, as shown in FIG. 8. This is the second actuator position of the actuator pawl 216. It can be seen that the contact arm 252 contacts the circuit board, closing the trailing move detector switch 250. It can also be seen that, even if the point rail PR rebounds to the right, the actuator pawl 216 will not open the trailing move detector switch 250.

Figure 9:
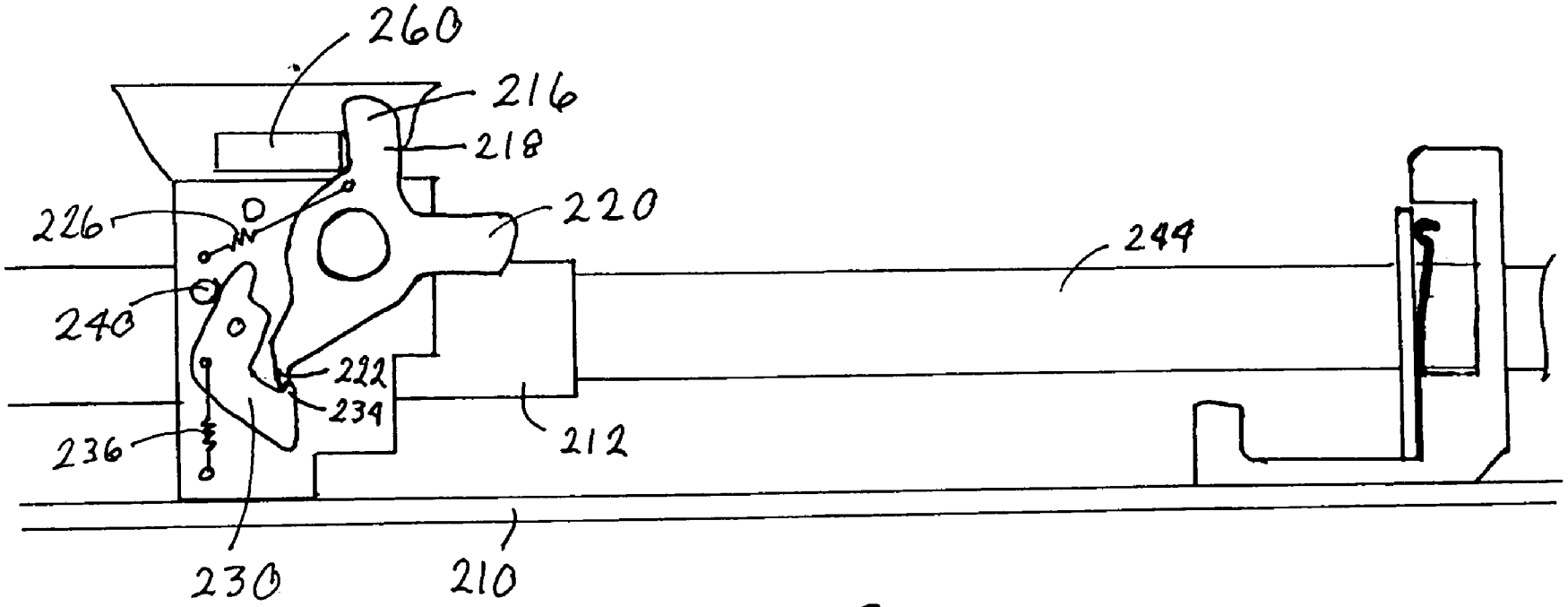
FIG. 9 is an elevation view of the apparatus shown in FIG. 6, in the reset position.

However, after inspecting the necessary equipment, an operator can move the point rail PR through its full stroke to reset the apparatus 200 as well as the switch machine. FIG. 9 shows the point rail follower piston 212 moved fully to the left. The reset extension 218 of the actuator pawl 216 has contacted a reset bar 260 mounted to the housing 210. This rotates the actuator pawl 216 in the clockwise direction, until the lower lip 222 on the actuator pawl 216 contacts and deflects the hook 234 on the latch 230, ultimately latching the lip 222 behind the hook 234. The latch spring 236 holds the latch 230 against the latch stop post 240, and the pawl loading spring 226 maintains the lower lip 222 in engagement with the hook 234. This holds the actuator pawl 216 in its reset position.

Figure 10:
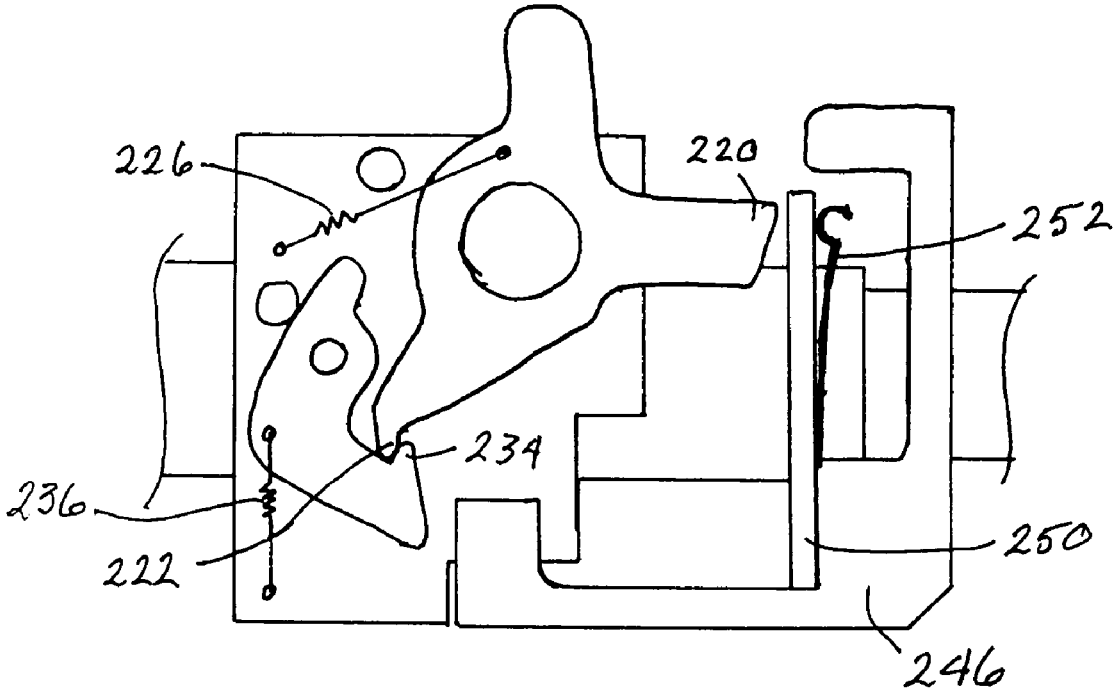
FIGS. 10 and 11 are elevation views showing the opening of the switch after resetting of the apparatus, as shown in FIG. 9.
Figure 11:
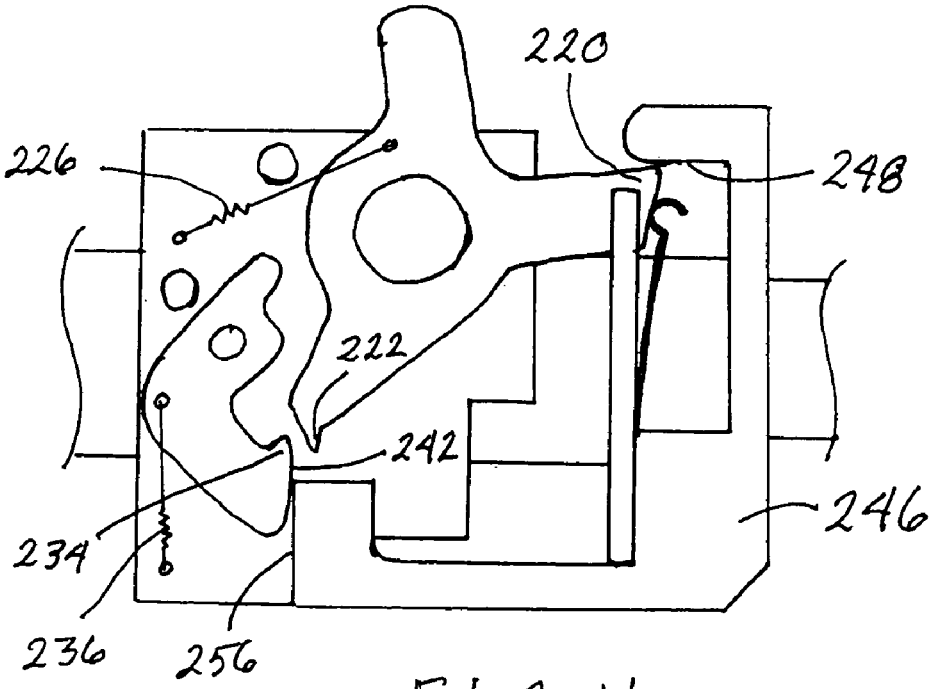

As shown in FIG. 10, as the point rail PR and the follower block 214 are moved back to the right, the contact extension 220 of the actuator pawl 216 moves underneath the pawl position stop face 248 of the contact base 246, with the latch 230 holding the actuator pawl 216 in its reset first actuator position. As shown in FIG. 11, as the contact extension 220 of the actuator pawl 216 moves under the pawl position stop face 248, the contact extension 220 also opens the trailing move detector switch 250. Further, the latch contact face 256 of the contact base 246 urges the latch 230 in the clockwise direction against the bias of the latch spring 236, releasing the lower lip 222 on the actuator pawl 216 from the hook 234 on the latch 230. This allows the contact extension 220 of the actuator pawl 216 to be held in position against the bias of the pawl loading spring 226 only by the pawl position stop face 248, and the apparatus 200 has been returned to its fully reset position as shown in FIG. 6.

This disclosure is merely illustrative of the preferred embodiments of the invention, and no limitations are intended other than as described in the appended claims.

We claim:

1. A non-powered apparatus for mechanically detecting a trailed switch incident in railroad track switching equipment, comprising:

an electrical contact within an associated track signaling circuit, said electrical contact having a first position in which said track circuit is not shunted and a second position in which said associated track circuit is shunted; and a non-powered mechanical actuator holding said electrical contact in said first position while an associated point rail remains within a first predetermined distance of an associated stock rail, said mechanical actuator being further moving said electrical contact to said second position upon movement of said associated point rail by said first predetermined distance away from said associated stock rail, said actuator being a rocking member arranged on a first pivot axis, and a pivoting member being arranged on a different pivot axis; wherein, said pivoting member controls a movement of the rocking member wherein said mechanical actuator remains stationary and leaves said electrical contact in said second position until said associated point rail moves away from said associated stock rail by a second predetermined distance in addition to said first predetermined distance.

2. The apparatus recited in claim 1, further comprising:

means for biasing said mechanical actuator to hold said electrical contact in said first position when said actuator is within a first portion of its range of motion;

wherein said biasing means is adapted to bias said mechanical actuator to move said electrical contact to said second position when said actuator is within a second portion of its range of motion; and wherein said movement of said associated point rail by said first predetermined distance is adapted to move said mechanical actuator from said first portion of its range of motion to said second portion of its range of motion.

3. The apparatus recited in claim 1, further comprising:

means for biasing said mechanical actuator to move said electrical contact toward said second position; and means for restraining said mechanical actuator from moving said electrical contact toward said second position;

wherein said movement of said associated point rail by said first predetermined distance is adapted to release said mechanical actuator from said restraining means, thereby allowing said mechanical actuator to move said electrical contact to said second position.

4. The apparatus recited in claim 1, further comprising:

a sensor adapted to follow movement of said associated point rail away from said associated stock rail, to displace said mechanical actuator;

a resetting component adapted to reposition said mechanical actuator upon movement of said point rail through said second predetermined distance.

5. The apparatus recited in claim 4, wherein:

said mechanical actuator is adapted to reposition said electrical contact to said first electrical contact position when said mechanical actuator is repositioned by said resetting component; and said sensor is adapted to return to its original position after said resetting of said actuator, without repositioning said actuator to said second actuator position.

6. The apparatus recited in claim 4, wherein:

said sensor is adapted to displace said mechanical actuator and said electrical contact away from each other, during said movement of said sensor;

said sensor is further adapted to follow movement of said associated point rail into contact with said associated stock rail, thereby displacing said mechanical actuator toward said electrical contact;

said electrical contact is adapted to remain in said second electrical contact position when said mechanical actuator is repositioned by said resetting component; and said mechanical actuator is adapted to reposition said electrical contact to said first electrical contact position when said sensor moves to follow movement of said point rail into contact with said stock rail.

7. A method for mechanically detecting a trailed switch incident in railroad track switching equipment, said method comprising:

providing an electrical contact having a first electrical contact position in which an associated track circuit is not shunted and a second electrical contact position in which said associated track circuit is shunted, said electrical contact being biased toward said second electrical contact position;

positioning a mechanical actuator to hold said electrical contact in said first electrical contact position, said actuator being a rocking member arranged on a first pivot axis, and a pivoting member being arranged on a different pivot axis; wherein, said pivoting member controls a movement of the rocking member;

sensing movement of a point rail away from a stock rail;

repositioning said mechanical actuator, responsive to said movement of said point rail by a first predetermined distance, to allow said electrical contact to reposition to said second electrical contact position to thereby shunt said track circuit; and maintaining said electrical contact in said second position with said mechanical actuator remaining stationary while said point rail moves by a second predetermined distance in addition to said first predetermined distance.

8. The method recited in claim 7, further comprising resetting said mechanical actuator upon movement of said point rail through said second predetermined distance.

9. The method recited in claim 8, further comprising:

repositioning said electrical contact to said first electrical contact position with said mechanical actuator when said actuator is reset; and returning said point rail to its original position after said resetting of said actuator.

10. The method recited in claim 8, further comprising:

moving said mechanical actuator away from said electrical contact upon said movement of said point rail by said first predetermined distance;

maintaining said electrical contact in said second electrical contact position when said mechanical actuator is reset to said first actuator position; and repositioning said electrical contact to said first electrical contact position with said mechanical actuator when said point rail returns to its original position after said resetting of said actuator.

* * * * *